US011529011B2

(12) United States Patent
Brown

(10) Patent No.: US 11,529,011 B2
(45) Date of Patent: Dec. 20, 2022

(54) PACKAGE DELIVERY RECEPTACLE AND METHOD OF USE

(71) Applicant: Florence Corporation, Manhattan, KS (US)

(72) Inventor: Chase C. Brown, Manhattan, KS (US)

(73) Assignee: Florence Corporation, Manhattan, KS (US)

( * ) Notice: Subject to any disclaimer, the term of this patent is extended or adjusted under 35 U.S.C. 154(b) by 261 days.

(21) Appl. No.: 16/890,033

(22) Filed: Jun. 2, 2020

(65) Prior Publication Data

US 2020/0390261 A1 Dec. 17, 2020

Related U.S. Application Data

(60) Provisional application No. 62/859,944, filed on Jun. 11, 2019.

(51) Int. Cl.
*A47G 29/20* (2006.01)
*A47G 29/14* (2006.01)

(52) U.S. Cl.
CPC ..... *A47G 29/20* (2013.01); *A47G 29/141* (2013.01)

(58) Field of Classification Search
CPC ..... A47G 29/20; A47G 29/1201; A47G 29/1225; A47G 29/141; E05B 65/0075; E05B 65/025; G07C 9/00912; E05G 1/026; Y10S 292/68
USPC ..... 232/19, 24, 25, 45, 1 E; 109/64, 66; 292/DIG. 68; 70/141
See application file for complete search history.

(56) References Cited

U.S. PATENT DOCUMENTS 5,223,829 A * 6/1993 Watabe ..... A47G 29/141 340/568.1
5,385,265 A 1/1995 Schlamp
5,820,018 A * 10/1998 Stacy ..... A47G 29/16 232/24
6,456,981 B1 9/2002 Dejaeger et al.
7,099,038 B2 8/2006 Schuller
8,589,310 B2 11/2013 Mayer et al.
9,082,247 B2 7/2015 Turner et al.
9,223,315 B2 12/2015 Irwin et al.
9,547,962 B2 1/2017 Motoyama
(Continued)

FOREIGN PATENT DOCUMENTS

FR 3100758 A3 * 3/2021 ..... B60L 53/30
WO WO 2017/163018 A2 9/2017

*Primary Examiner* — William L Miller
(74) *Attorney, Agent, or Firm* — Leydig, Voit & Mayer, Ltd.

(57) ABSTRACT

A system and method of delivering a package to a residence having an address and a locker with a lock is disclosed. The method comprises the steps of, remotely selecting an item from a menu of items provided by a vendor and requesting the item be delivered to the residence, providing the vendor delivery information including the address and the combination code to the lock, shipping the package to the residence, reviewing the combination code associated with the package, opening the locker by manipulating the proper combination on the lock, placing the package in the locker; and closing door of the locker. The locker has an outer frame and door that cooperate to allow any liquid to drain out from the front of the locker and outside the residence and a combination lock that allows for the combination to be easily changed by the resident.

11 Claims, 10 Drawing Sheets

(56) References Cited

U.S. PATENT DOCUMENTS

| | | | | |
|---|---|---|---|---|
| 9,604,258 | B2 | 3/2017 | Layne et al. | |
| 9,604,259 | B2 | 3/2017 | Losso et al. | |
| 9,715,780 | B2 | 7/2017 | Garrison | |
| D864,515 | S | 10/2019 | Hirvesaar | |
| D881,503 | S | 4/2020 | Hirvesaar | |
| 10,621,811 | B2 | 4/2020 | Tovey et al. | |
| 10,909,789 | B2 * | 2/2021 | Gokcebay | E05B 65/025 |
| 2001/0045449 | A1 * | 11/2001 | Shannon | G07C 9/21 232/19 |
| 2002/0035515 | A1 | 3/2002 | Moreno | |
| 2002/0054370 | A1 | 5/2002 | Hara | |
| 2002/0130172 | A1 | 9/2002 | Hara | |
| 2002/0177922 | A1 | 11/2002 | Bloom | |
| 2003/0025590 | A1 | 2/2003 | Gokcebay et al. | |
| 2003/0195696 | A1 | 10/2003 | Jones | |
| 2006/0151588 | A1 * | 7/2006 | Mikolajczyk | A47G 29/1201 232/24 |
| 2007/0296579 | A1 | 12/2007 | Mayer et al. | |
| 2008/0082257 | A1 | 4/2008 | Lee | |
| 2009/0278426 | A1 * | 11/2009 | Vinke | E05B 63/18 312/215 |
| 2010/0057580 | A1 | 3/2010 | Raghunathan | |
| 2010/0197293 | A1 | 8/2010 | Shem-Tov | |
| 2010/0203831 | A1 | 8/2010 | Muth | |
| 2011/0125664 | A1 | 5/2011 | Kadaba | |
| 2011/0144798 | A1 | 6/2011 | Freudelsperger | |
| 2012/0130916 | A1 | 5/2012 | Neal et al. | |
| 2012/0194043 | A1 | 8/2012 | Turner et al. | |
| 2012/0306617 | A1 | 12/2012 | Tung | |
| 2013/0144428 | A1 | 6/2013 | Irwin et al. | |
| 2013/0159194 | A1 | 6/2013 | Habib | |
| 2013/0198101 | A1 | 8/2013 | Beckerle et al. | |
| 2013/0261792 | A1 | 10/2013 | Gupta et al. | |
| 2013/0286046 | A1 | 10/2013 | Rodriguez | |
| 2013/0307382 | A1 | 11/2013 | Garrison | |
| 2013/0337890 | A1 | 12/2013 | Earley et al. | |
| 2013/0338822 | A1 | 12/2013 | Gibson, Jr. et al. | |
| 2014/0114875 | A1 | 4/2014 | Murthy et al. | |
| 2014/0120901 | A1 | 5/2014 | Ward et al. | |
| 2014/0279666 | A1 | 9/2014 | Lievens et al. | |
| 2014/0316916 | A1 | 10/2014 | Hay | |
| 2014/0330603 | A1 | 11/2014 | Corder et al. | |
| 2014/0373184 | A1 | 12/2014 | Mahaffey et al. | |
| 2015/0081583 | A1 | 3/2015 | Butler et al. | |
| 2015/0091693 | A1 | 4/2015 | Bibeau et al. | |
| 2015/0106291 | A1 | 4/2015 | Robinson et al. | |
| 2015/0120601 | A1 | 4/2015 | Fee | |
| 2015/0133051 | A1 | 5/2015 | Jamal-Syed et al. | |
| 2015/0186840 | A1 | 7/2015 | Torres et al. | |
| 2015/0356801 | A1 | 12/2015 | Nitu et al. | |
| 2016/0106291 | A1 | 4/2016 | Eun | |
| 2018/0033235 | A1 | 2/2018 | Dotterweich et al. | |
| 2018/0182189 | A1 | 6/2018 | Lakshmi-Ratan et al. | |
| 2019/0114585 | A1 | 4/2019 | Fee et al. | |
| 2019/0114859 | A1 | 4/2019 | Fee et al. | |
| 2019/0370744 | A1 | 12/2019 | Fee et al. | |
| 2020/0066077 | A1 * | 2/2020 | Hara | G07C 9/00912 |
| 2020/0066086 | A1 | 2/2020 | Fee et al. | |
| 2021/0217261 | A1 * | 7/2021 | Green | G08C 17/02 |
| 2021/0330111 | A1 * | 10/2021 | Nowinski | F25D 25/04 |
| 2022/0125230 | A1 * | 4/2022 | Jordan | A47G 29/141 |

* cited by examiner

PACKAGE DELIVERY RECEPTACLE AND METHOD OF USE

CROSS REFERENCE TO RELATED APPLICATION

This application claims the benefit of, and priority to, U.S. Provisional Patent Application No. 62/859,944 filed Jun. 11, 2019, which is incorporated by reference herein in its entirety.

TECHNICAL FIELD

The present disclosure relates to a receptacle for accepting delivery of packages at a residence and a system and method for efficient and secure delivery of packages at a residence using the receptacle.

BACKGROUND

Consumers are increasingly embracing online shopping and are spending increasing amounts with online retailers. With the increased use and confidence of online retailing, not only is the frequency of packages being delivered increasing, but also the value and size of products purchased is increasing. Some online retailers have used increasing economies of scale to help reduce the costs of shipping purchases to the consumer. Traditional brick-and-mortar retailers have also embraced this shift in consumer demand and introduced online storefronts, along with incentives encouraging consumers to make purchases online for later delivery. Accordingly, an increasing number of packages of various, but in many cases increasing, sizes are being shipped to consumers, and multiple packages are being received by a resident in a single day. However, residents are often not home or otherwise available during the day when packages are being delivered to their residences. In some instances, the shipper simply places the package in an unsecured location, such as near a door, a mailbox at the end of a driveway, or on the porch of a residence. This presents the possibility of the packages being stolen or subjected to the elements before the resident can retrieve the package.

In some situations, where a package cannot be left at a secure location at a residence or with the residents themselves when the resident is not home, shippers have developed a process whereby the shipper does not deliver the package, but instead leaves a note on the door of the residence advising the resident that the package can be picked up by the resident at a hopefully nearby central location. The resident can then later, retrieve the package using an identifier. Such a solution helps reduce losses for the shipper, but this solution obviously inconveniences both the shipper and the resident.

The system described here helps address these and other problems and provides a receptacle such as a locker for accepting delivery of packages at a residence and a system for ordering and securely delivering packages at a residence using the receptacle. The receptacle may be provided with a lock whose combination may be easily changed by the recipient in order to keep the system up-to-date.

SUMMARY OF THE DISCLOSURE

The invention provides a receptacle for secure delivery of packages to a residence comprising a locker adapted to be recessed into a wall of the residence with the locker having a top wall, a bottom wall, a back wall, a first side wall, a second side wall and a door, with the second side wall having a front face and the door substantially co-planar with a wall of the residence. One side of the door is hingedly attached to the first side wall, and the other side of the door has a combination lock with a latch having an outwardly biased cam surface, with the latch cooperating with a catch in the second locker side wall to releasably hold the door shut. When the door is closing, the cam surface contacts the front face of the locker second side wall to initially move the latch inwardly and the bias counteracts it to move the latch outwardly into the catch to hold the door closed. The lock has a rotatable dial, a plurality of push buttons and a programming slide. The door can be opened by punching the proper combination of buttons and turning the dial to rotate the latch away from the catch. The combination on the lock can be easily changed by pressing the buttons of the current combination, turning the dial, sliding the programming slide and pushing a new combination of buttons.

The invention also provides a method of delivering a package containing an item to a residence having an address and a locker located proximate a delivery location at the residence, the locker also having a combination lock, the method comprising the steps of, remotely selecting an item from a menu of items provided by a vendor and requesting the item to be delivered to the residence, providing the vendor delivery information for the item, the delivery information including the address and the combination code to the lock on the locker, placing the product in a package, the package including the delivery information, shipping the package to the proximate delivery location at the residence, reading the combination code on the package, opening the locker by manipulating the proper combination on the lock, placing the package in the locker; and closing door of the locker.

A receptacle for secure delivery of packages to a residence having a least one outer wall comprising a locker adapted to be recessed into the outer wall of the residence, the locker having a top wall, bottom wall, a first side wall and a second side wall, each of the walls having a depth and a front face. The locker also comprises a door having a front surface substantially co-planar with the outer wall of the residence and an inner surface, with the door also having a hinge on one side pivotally connecting the door to the front face of the first side wall and a lock with a latch proximate the opposite side cooperating with a catch in the second side wall. When the door is closed, the inner surface of the door on the side near the latch contacts the front face of the second locker side wall but there is space between the inner surface of the door near its top and bottom and the end faces of the top and bottom locker walls to allow air to circulate within the locker when the door is closed.

The invention also provides a receptacle for secure delivery of packages to a residence having a least one outer wall comprising a locker adapted to be recessed into the outer wall of the residence, the locker having a top wall, bottom wall, a first side wall and a second side wall, each of the walls having a depth and a front face. The locker also comprises a door having a front surface substantially co-planar with the outer wall of the residence and an inner surface; the door also having a hinge on one side to pivotally connect the door to the front face of the first side wall and a lock with a latch proximate the opposite side. The locker bottom wall is slanted downwardly from the back of the locker to the front of the locker and also has a front sill, with the sill spaced below and extending under the door. When the door is closed, the inner surface of the door on the side near the latch contacts the front face of the second locker side wall but there is space between the inner surface of the bottom of the door and the end face of the bottom locker wall to allow liquid within the locker to drain between front end of the bottom wall and the inner surface of the door and between the bottom of the door and the top of the sill and out of the locker when the door is closed.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice versa without limiting the scope of the disclosure to the exact number or type of such elements unless set forth explicitly in the appended claims. The terms configured and configuration may be used herein to refer to a specified arrangement, or a structural size and shape.

Figure 2:
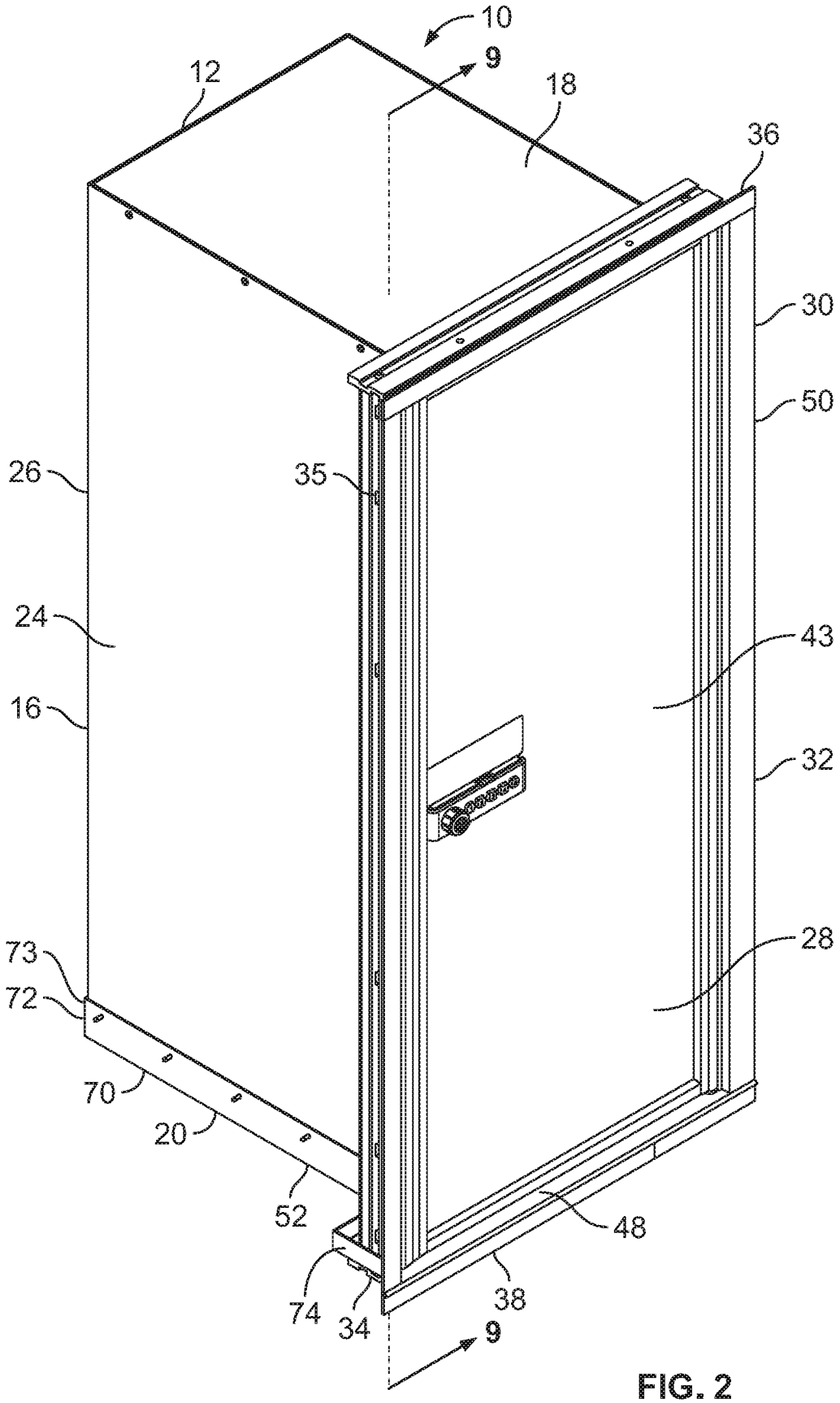
FIG. 2 is a perspective view of the receptacle.
Figure 3:
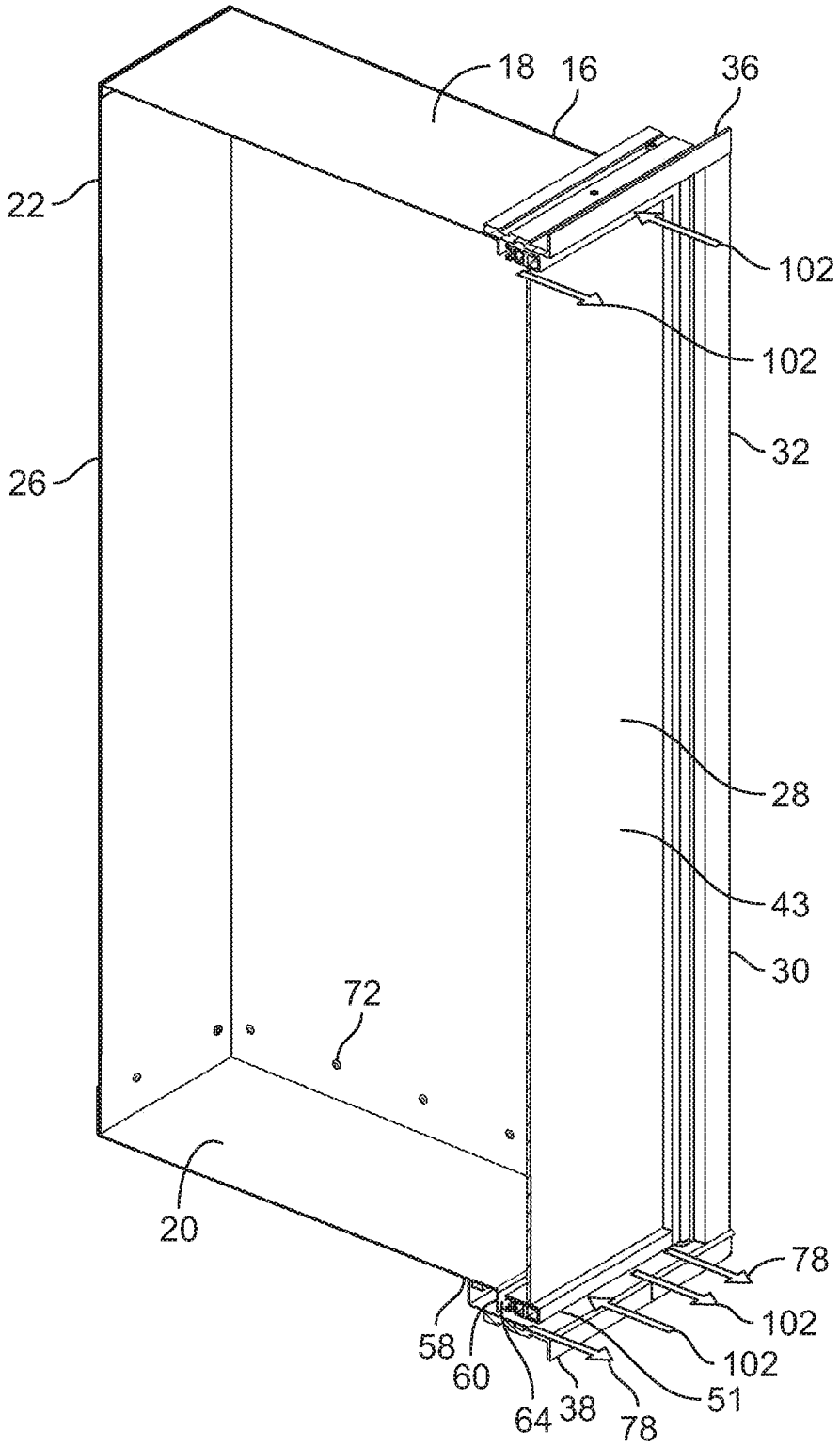
FIG. 3 is a perspective sectional view of the receptacle with representative arrows showing air flow and water flow.
Figure 4:
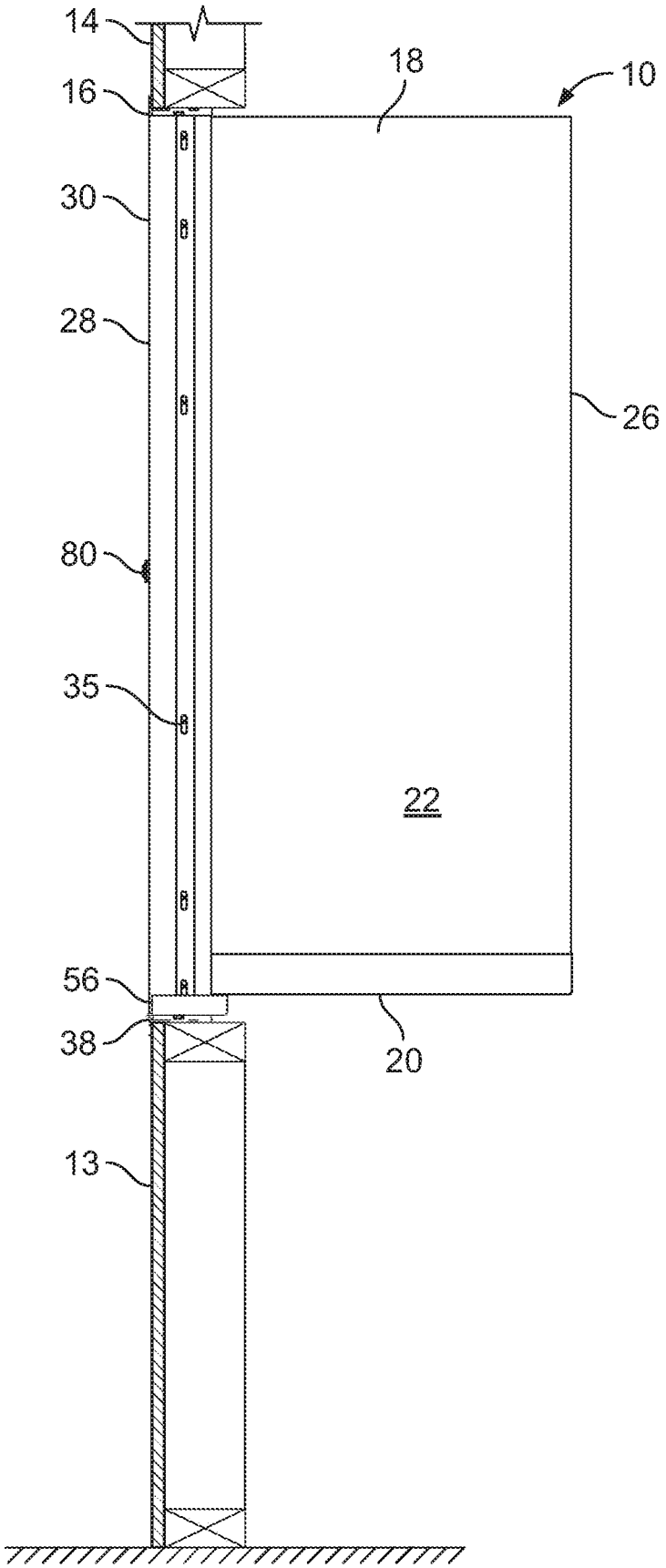
FIG. 4 is a side view of the receptacle mounted in the wall of a residence.
Figure 10:
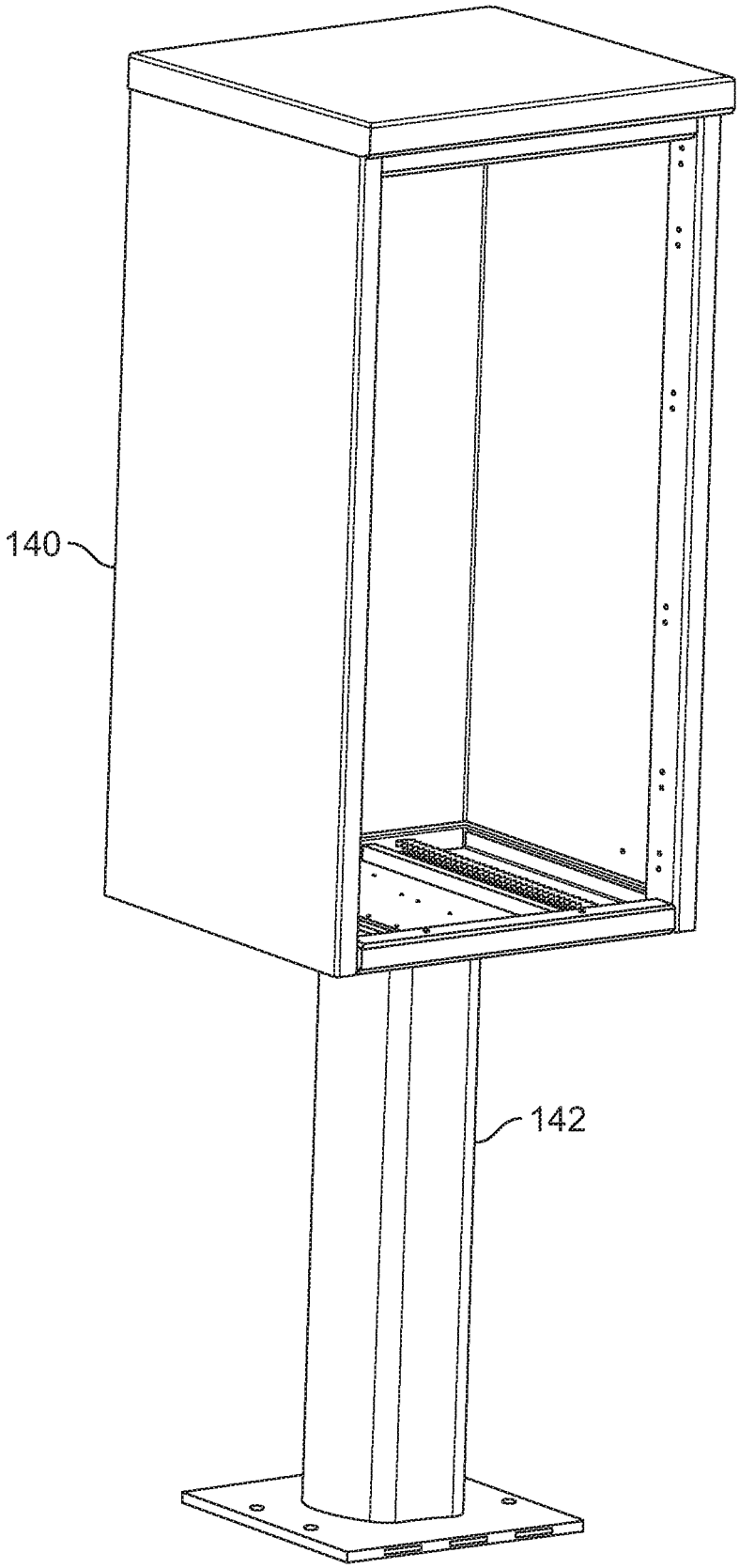
FIG. 10 is a perspective view of a pedestal and cabinet for mounting a receptacle.

FIGS. 4 and 10 show locations for mounting a receptacle 10 for the secure deliver of packages, not shown, to or near a residence 14. As also seen in FIG. 2, the receptacle may be a locker 16 having a top wall or ceiling 18, a bottom wall or floor 20 a right side wall 22 and a left side wall 24. Each wall may be made of aluminum, corrosion resistant steel, or other material that is not easily penetrable. The locker 16 also has a back wall 26 (see FIG. 3) and a door 28 on the front side. In one embodiment, the back wall may be a door with a lock to allow selected ingress to the locker from inside the residence. As seen in FIG. 4, in one embodiment, the locker is adapted to be recessed into the wall 13 of the residence so that the outer surface of the door 28 is substantially coplanar with the outer surface of the residence wall 13. In another embodiment, as seen in FIG. 10, the receptacle 10 or locker 16 is adapted to be mounted in a housing or cabinet 140 on a pedestal 142 anchored to the ground near a residence. For example, the locker may be located at the end of a driveway to a residence or near a mailbox used for delivering mail to the residence.

Figure 5:
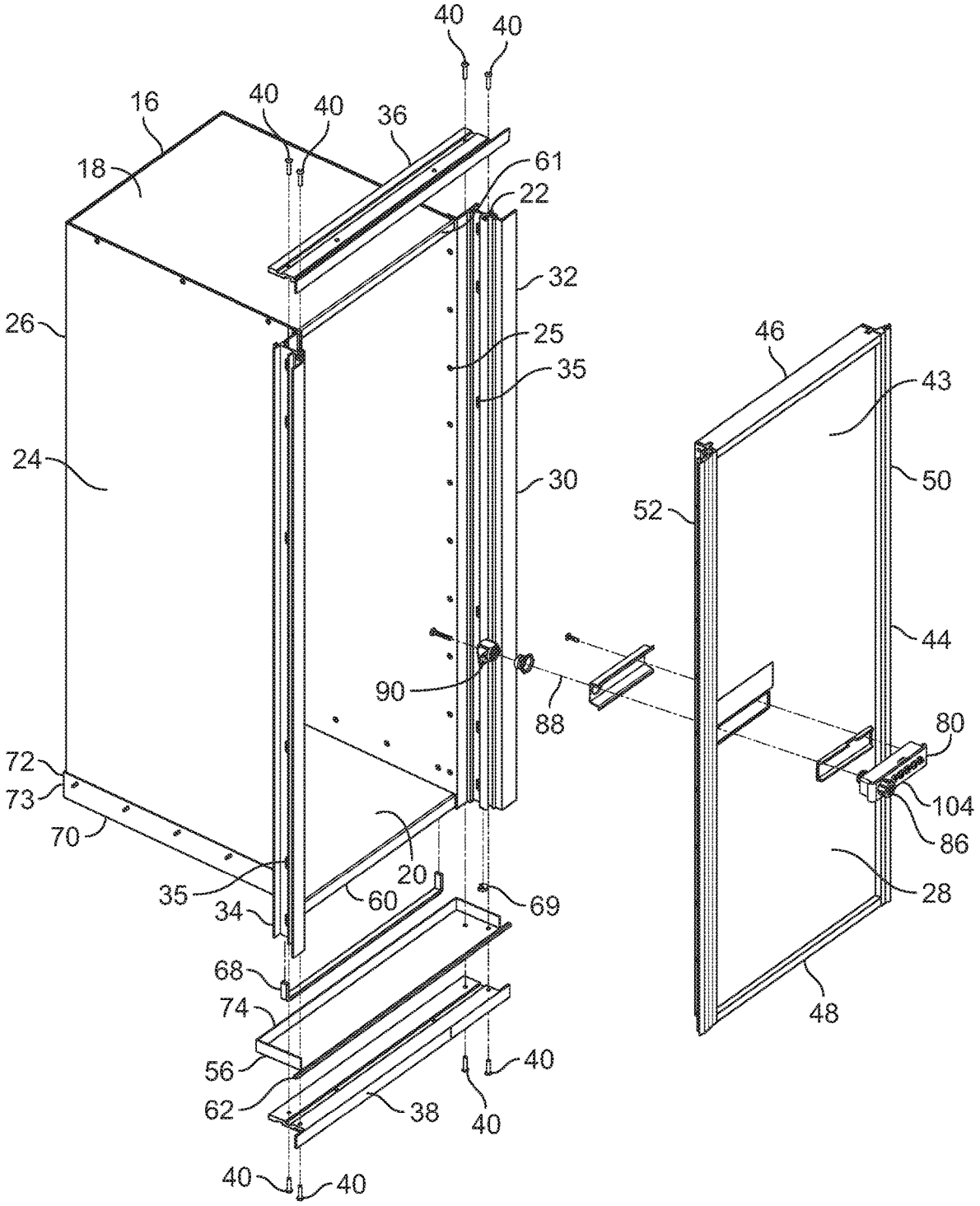
FIG. 5 is an exploded perspective view of the receptacle.
Figure 7:
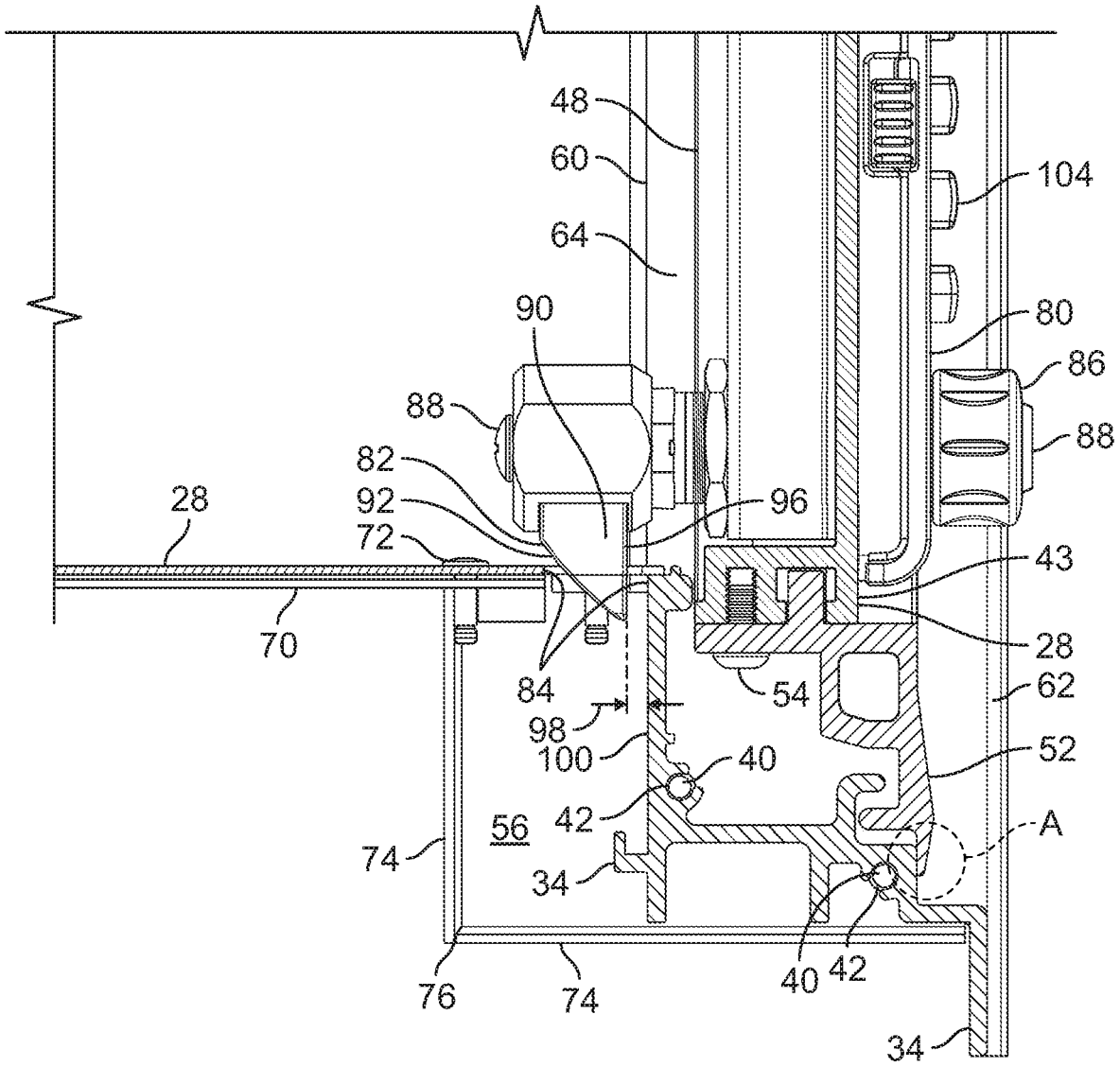
FIG. 7 is a cross sectional view of the door and one side of the receptacle just above the lock looking downwardly.

The locker 16 also comprises a frame 30 around the periphery of the front sides of the walls 18, 20, 22 and 24. The bottom wall has a front surface 60 and the top wall has a front surface 61. As shown in FIG. 5, the frame 30 has a right vertical frame 32 attached to the front end of the right side wall 22 and a left vertical frame 34 attached to the left side wall 24 preferable by screws or rivets 25. As seen in FIGS. 2, 4 and 5, the vertical frames 32 and 34 have cutouts 35 through which fasteners, such as screws, can extend outwardly into the rough opening of the residence to secure the receptacle 10 to the residence 14 or to the cabinet 140. As seen in FIG. 7, a cross section of the left vertical frame 34, in a preferred embodiment, the right vertical frame 32 and left vertical frame 34 are aluminum extrusions of unique shape to enhance the structural integrity of the receptacle as well as its manufacturability. The frame 30 also comprises a top horizontal frame 36 and a bottom horizontal frame 38 also uniquely and complementarily shaped. The top frame 36 and bottom frame 38 may also be constructed of aluminum extrusions and are attached to the right frame 32 and left frame 34 by screws 40 that extend into grooves 42 in the vertical extrusions as best shown in FIGS. 5 and 7.

In one embodiment, the door 28 is attached to the right or first vertical frame 32 by a hinge 66 to allow it to swing outwardly to open. A left side hinge mounted to the left or second vertical frame 34 is also contemplated by the invention. In a preferred embodiment, the door 28 and has a substantially planar portion 43 and a door frame 44, which is preferably also made of aluminum extrusions. The door frame 44 has a top door frame portion 46, a bottom door frame portion 48, a right door frame portion 50 and a left door frame portion 52. The door frame portions are attached to each other and the door by door screws 54, and not unlike the locker frame, by fasteners that fit into complementary grooves in the door frame extrusions. In one embodiment, when the door is fully closed, the left door frame portion 52 contacts the left vertical frame 34 extrusion as best seen in FIG. 7 at location A. Optionally, the door 28 may also include a sign (not shown) indicating whether the locker 16 contains a package 12 or whether the locker is empty, for example a sign that toggles between indications that the locker 16 is Full or Empty. The sign may be mounted on the planar portion 43 of the door 28 or may be incorporated into the lock 80.

Figure 6:
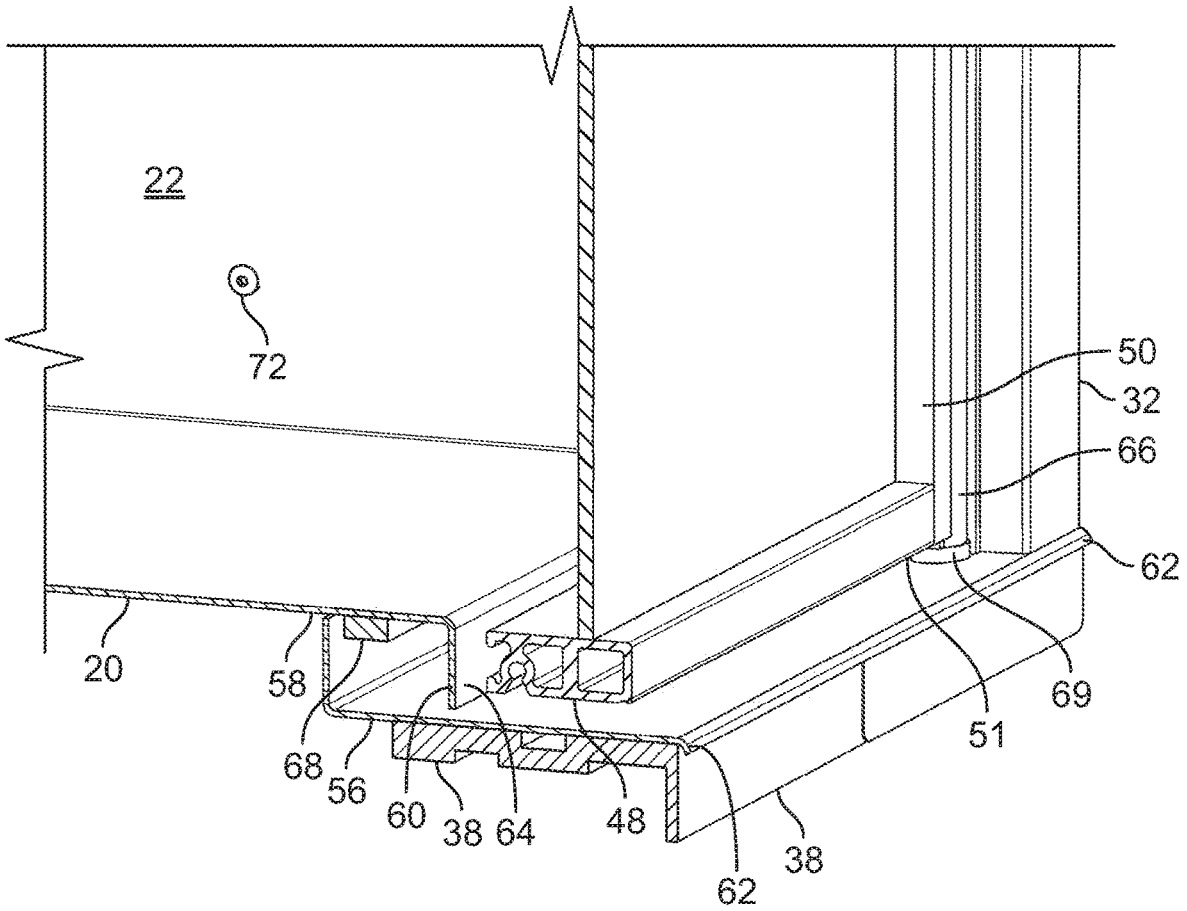
FIG. 6 is a detail perspective cross sectional view of the bottom portion of the receptacle.

When the receptacle is properly installed in the wall 13 of a residence 14 or in a cabinet 140 the bottom wall 20 has a slight downward slope from the back wall 26 to the front portion 58 of the bottom wall. The front portion 58 of the bottom wall 20 has a downwardly facing front surface or lip 60. A door sill 56 is also attached and extends downwardly and forwardly from the front portion 58 of the bottom wall 20. The sill 56 also sits atop the bottom horizontal frame 38 and has a downward sill lip 62 that extends in front of the bottom frame 38. In a preferred embodiment, a closed cell urethane strip 68 also is adhesively attached to the underside of the bottom wall 20 near the front portion. A spacer 69 (see FIGS. 5 and 6) is positioned at the bottom of the hinge on the sill 56 so that the lower side of the bottom door frame portion 48 is spaced above the door sill 56 to create a gap 51 between the bottom of the door frame portion 48 and the top of the sill 56. In a preferred embodiment, this gap 51 is approximately 0.200 inches. The spacer 69 also works as a bearing surface on the bottom of the door to facilitate the pivoting of the door. As best seen in FIGS. 3 and 6, even when the door 28 is fully closed, there is also a vertical gap 64 between the rear of the bottom door frame portion 48 and the downward lip 60 at the front end of the bottom wall. In a preferred embodiment, this gap is approximately 0.25 inches. With this construction, any liquid, such as rainwater, or spilled liquids from within the locker, 16 can flow forwardly along the bottom wall 20 through the gap 64 and under the bottom door frame portion on top of the sill 56 and over the sill lip 62 to the exterior of the locker 16 and outside of the wall 13 of the residence or the housing 140, as depicted by the large arrows 78 in FIGS. 1 and 3. Any liquid that might migrate up under the bottom wall 20 toward the inside of the residence will be halted by the closed cell strip 68 so that it falls onto the door sill 56 and exits the residence 14 as depicted by the arrows 78. The gaps 51 and 64 also allow air to flow beneath the door from inside the receptacle to the outside as depicted by arrows 102 in FIGS. 1 and 3.

The bottom wall 20 has an upstanding lip 70 around the two sides and the back. Creases 73 in the back corners are formed by bending the lips 70 upwardly. The creases are sealed with a sealant so that liquid does not leak through them. The lip 70 is held onto the right side wall 22, the left side wall 24 and back wall 26 by fasteners such as rivets 72. Accordingly, the interior of the bottom of the locker 16 is essentially watertight so, as described above, any liquid in the locker will find its way out the front of the locker. As can be seen in FIGS. 2 and 5, the door sill 56 also has an upstanding lip 74 along its sides and back. The creases 76 formed between the upstanding back lip and each of the side lips is filled with sealant to again create a watertight seal. The door sill 56 is wider than the distance between the right 32 and left 34 vertical frames, so the lips 76 will catch any liquid and the liquid will drip out the front as depicted by arrows 78. This construction provides a locker that can be easily installed in the rough opening of a residence wall 13, but will not allow water or other liquids to penetrate the wall.

A lock, 80, preferably a combination lock, is located on the left side of the door 28 in a preferred embodiment. The lock 80 has a latch 82 that cooperates with a catch 84 to retain the door 28 shut while the door is in the closed condition. The catch 84 can be an opening or recess between the front end of the left side wall 28 and the left frame 34 approximately half way up the side wall. The latch has a finger 90 with a cam surface 92, a back surface 96 and a biasing means, such as a spring (not shown) that biases the finger outwardly into the catch 84. The lock also has a dial or knob 86 mounted on the outside of the door 28 that is attached to the latch 82 on the inside of the door to rotate the latch 82 about a horizontal axis 88 that runs through the door 28. By turning the knob 86, for example, ninety degrees clockwise, the finger 90 rotates out of the catch 84 and the door can be opened by pulling on the knob 86. In one embodiment, the door 28 can be closed by merely pushing on the left side of the door, in which case the latch cam surface 92 contacts the locker side frame 34 and the finger 90 is moved inwardly against the spring bias until the door is closed, door side frame 52 contacts the locker side frame 34 and the cam surface 92 passes over the locker side frame, and the finger 90 is biased into the recess formed by the catch 84. Alternatively, in another embodiment, the door can be closed or opened by turning the knob 86 to rotate the finger out of catch 84 and away of the left side frame 34.

Figure 1:
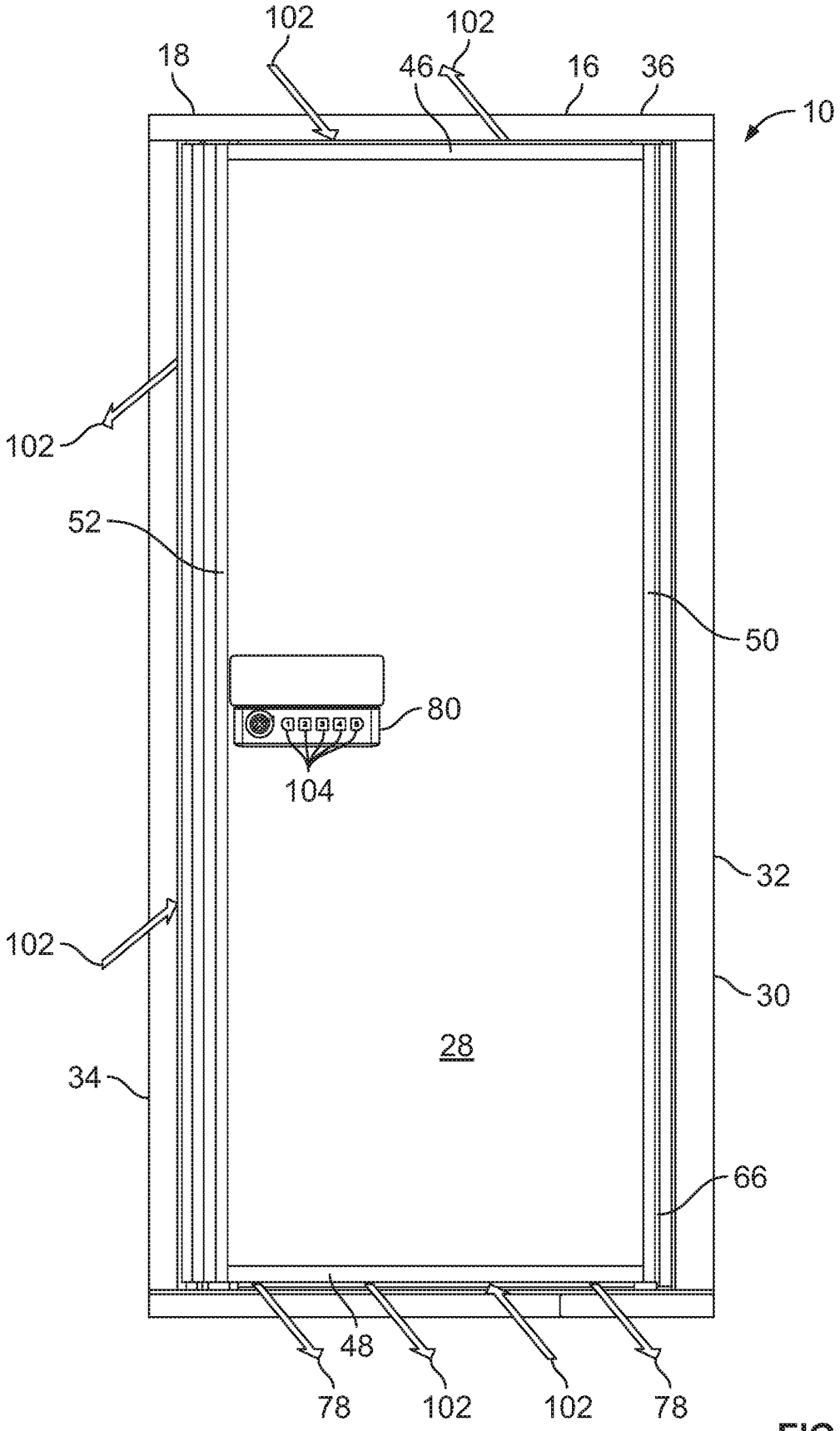
FIG. 1 is a front elevation view of the receptacle with representative arrows showing air flow and water flow.

The finger 90 also has a back surface 96. When the door 28 is fully closed, the finger back surface 96 is spaced by a distance 98 from a facing rear surface 100 of the left vertical frame 34 as seen in FIG. 7. This gap may also allow the door to remain slightly ajar to allow air flow between the left side door frame 52 and the left side locker frame 34. In the slightly ajar embodiment, unlike what is shown in FIG. 7, the door frame 52 does not contact the left locker frame 34 at location A, but instead the gap 98 is located at location A along the length of the door, and the back side 96 of the finger 90 contacts the locker left side frame 34. In the slightly ajar embodiment, the gap along the entire left side of the door may be further ensured by bumpers or other protrusions on either the left door frame 52 or the left locker frame 34. As noted above, this gap allows air to pass in and out of the locker 16 along the left side of the door as denoted by the small arrows 102 as shown in FIG. 1. As described above with respect to water drainage, there is also a gap at the bottom of the door, which allows air to pass between the bottom of the door, the sill and the bottom wall. In one embodiment, there is also a gap between the front face 61 of the top wall 18, and the rear surface of the door when closed to allow for air passage. There is also a gap between the top horizontal locker frame 36 and the top door frame 46 to allow air to pass as also depicted by arrows 102. In the unlikely, but unfortunate occurrence that a person becomes trapped inside the locker, the air passage will allow them to breathe. Moreover, these gaps allow for slight misalignment or racking in the installation of the locker.

In a preferred embodiment, the lock also comprises a plurality of push buttons 104, which must be pushed in the proper sequence or combination code in order to turn the dial 86 to unlock the lock 80 and open the door 28. In a preferred embodiment, there are five push buttons. In a preferred embodiment, the lock is an EcoForce recessed mount, no-battery, push button lock made by CompX security products of Mauldin, SC. This lock requires no electricity, is easy to use and is relatively easy to change the combination by an authorized user by using the buttons 104 and programming slide 105. The lack of need for electrical power allows the locker to be easily incorporated into building plans. However, in other embodiments a battery powered lock is incorporated into the locker. In a further embodiment, electrical power from the residence may power a lock as well as a light inside the locker.

The receptacle 10 is incorporated into an inventive system for ordering and delivering packages to a residence 14. As shown in FIG. 4, the receptacle, preferably a locker, 16, is adapted to be recessed into a wall of the residence 14 so the door 28 is substantially co-planar with the wall 13 for an aesthetically pleasing look. The locker is preferably located near a delivery location, such as a door or porch of the residence so the delivery person can easily locate the locker 16. In this disclosure, the term packages includes boxes and envelopes with printed addresses, but also includes anything that may have a self-identifying address or destination on or associated with the item. For example, dry cleaning or carryout food may have an invoice or on-line order that the delivery person has in a remote device that she carries with her, but may not be directly on the item, but is associated with the item and/or recipient.

Figure 8:
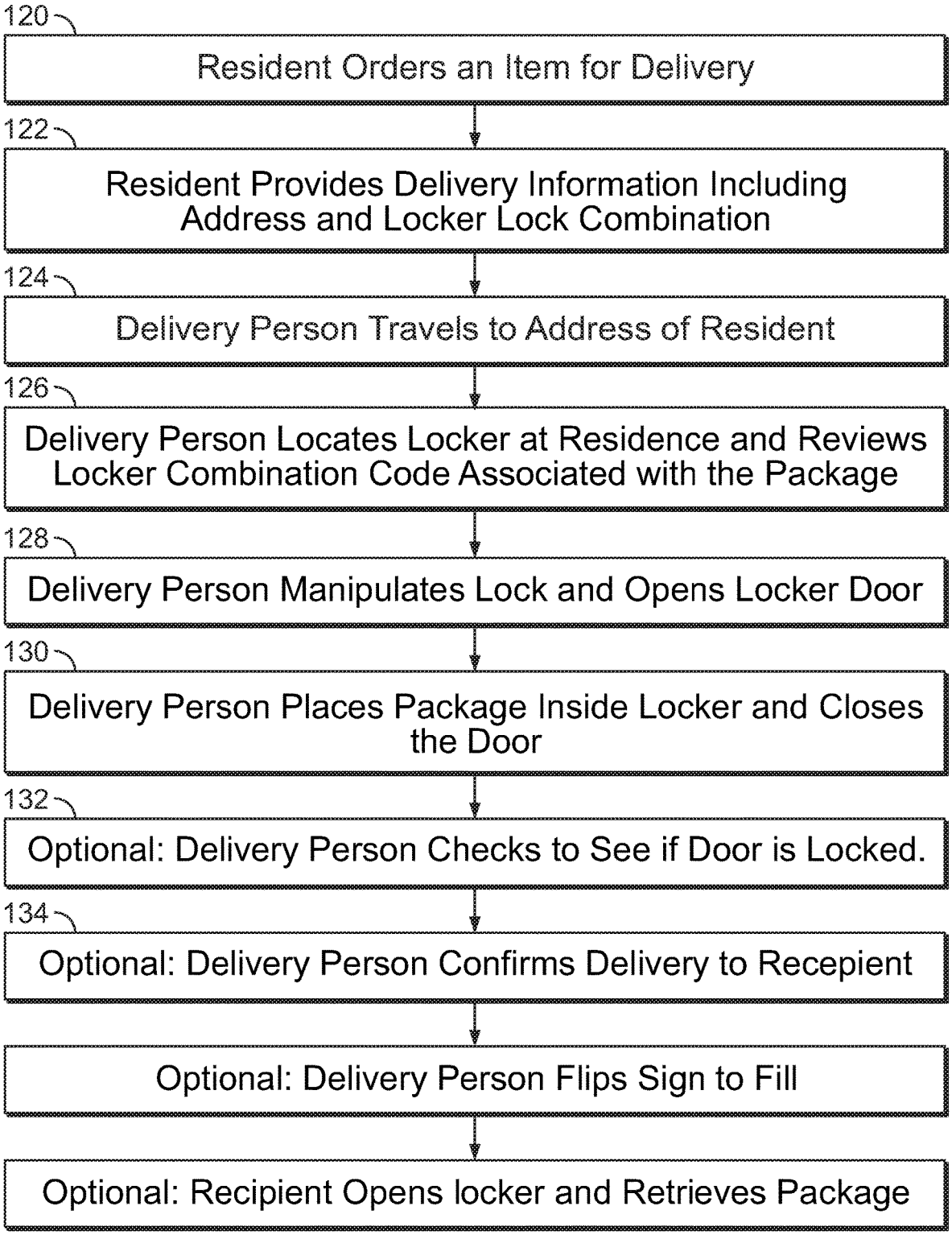
FIG. 8 is a block diagram of the inventive steps of the invention.
Figure 9:
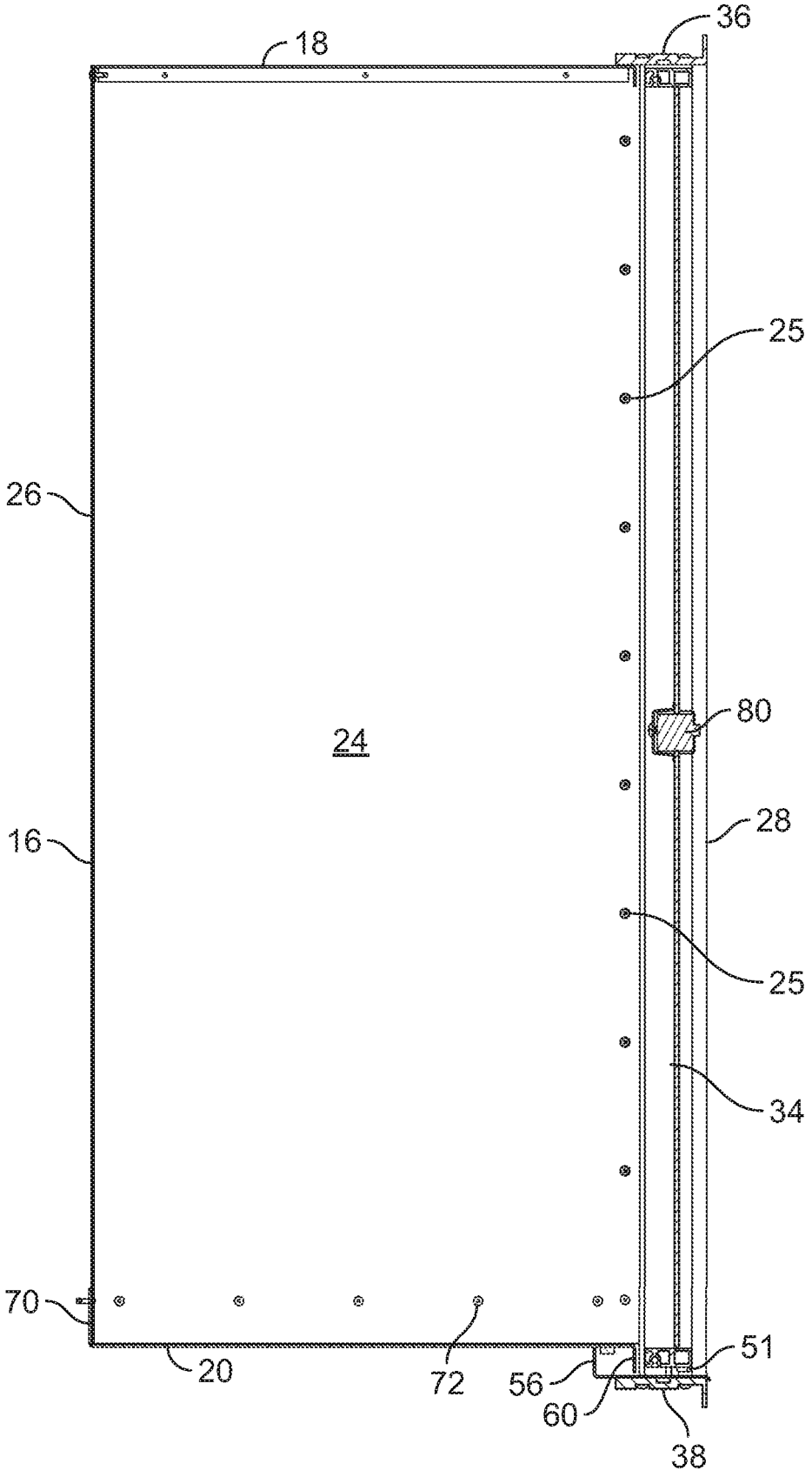
FIG. 9 is a cross sectional side elevation view of the receptacle.

As depicted in FIG. 8, a resident ordering an item for delivery 120, preferably remotely on-line or by telephone or similar means initiates the inventive system. This ordering step 120 could also include the resident traveling to a remote location such as a vendor's store, selecting an item and requesting delivery. The resident next provides the vendor delivery information 122 for the item. In one embodiment, the item is placed in a package that includes written delivery information on the outside of the package. As noted above, in another embodiment, the delivery information is remotely associated with the item either physically or electronically so that the term package as used herein means any item with associated delivery information. The delivery information includes the address of the residence 14 and the combination code to the lock 80 on the locker. In some embodiments, such as when a resident orders numerous items from the same vendor, the delivery information automatically included in the order when the resident identifies herself or her residence address. In some embodiments, the delivery information may additionally include specific instructions for the delivery person to locate the locker 16 at the residence 14 and use the locker 16 for delivery.

Next, the delivery person travels to a location proximate the residence 124. When the delivery person arrives at the residence and approaches the delivery location associated with the residence, the delivery person locates the locker proximate the delivery location and reads or has in his memory the combination code associated with the package 126 or residence. Upon review of the combination code associated with the package or address of the residence, the delivery person manipulates the lock 80 to operate the combination code and opens the locker door 128. The delivery person then places the package or packages containing the item or items in the locker, closes the door 130 and moves on the next residence. In one optional step, the delivery person confirms the door is locked 132, for example by rattling the door, or initiating an electronic confirmation. In another optional step, the delivery person may confirm delivery of the package to the vendor, the resident or both either electronically or manually 134. In a further optional embodiment, the delivery person manipulates a manual sign on the door that the locker is now full. In one embodiment, to complete the transaction the resident opens the locker and retrieves the package and further optionally confirms receipt.

Although the above described receptacle and system have been described, modifications to the device and system are contemplated by this disclosure. Various embodiments disclosed herein are to be taken in the illustrative and explanatory sense, and should in no way be construed as limiting of the present disclosure. While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

I claim:

1. A receptacle for secure delivery of packages to a residence having a least one outer wall comprising:

a. a locker recessed into the outer wall of the residence, the locker having a top wall, bottom wall, a back wall, a first side wall, a second side wall having a front face, and a door, with the door substantially co-planar with the outer wall of the residence;

b. one side of the door attached to the first side wall by a hinge to allow the door to pivot about the first side wall from an open to a closed condition;

c. the other side of the door having a combination lock with a latch having a finger biased outwardly from the other side of the door by a biasing means, the finger having a cam surface on one side with the latch finger cooperating with a catch having a recess in the second side wall to releasably hold the door shut;

d. wherein when the door is closed, the cam surface contacts the front face of the second side wall to initially move the latch finger inwardly against the biasing means, and, upon further pivoting of the door, the biasing means moves the latch finger outwardly into the catch recess to hold the door closed; and e. the lock has a rotatable knob, a plurality of push buttons and a programming slide;

f. wherein the door is opened by pushing the proper combination of the buttons and turning the knob to move the latch away from the catch; and g. wherein the combination on the lock is changed by pressing the buttons of the proper combination, turning the knob, sliding the programming slide and pushing a new combination of the buttons.

2. The receptacle of claim 1 wherein the locker top wall and bottom wall have front surfaces and the bottom wall also has a sill extending downwardly and forwardly from the front surface of the bottom wall, and the door has a rear surface and a bottom surface, and wherein when the door is closed, the rear surface of the door is spaced from the locker top wall front surface and from the locker bottom wall front surface, and the door bottom surface is spaced from the sill to allow air to flow into and out of the locker at the top and bottom of the door.

3. The receptacle of claim 2 wherein the locker also comprises a spacer located between the bottom surface of the door and the sill proximate the hinge to create the space between the door bottom surface and the sill when the door is closed and act as a bearing surface between the bottom surface of the door and the sill to facilitate the pivoting of the door.

4. A receptacle for secure delivery of packages to a residence having a least one outer wall comprising:

a. a locker recessed into the outer wall of the residence, the locker having a top wall, a bottom wall, a first side wall and a second side wall, each of the walls having a depth and a front surface;

b. the locker comprising a door having a front surface substantially co-planar with the outer wall of the residence and an inner surface, the door also having a hinge on one side proximate the first side wall to pivotally connect the door to the front faee surface of the first side wall and a lock with a latch proximate the opposite side;

c. the locker bottom wall being slanted downwardly from the back of the locker to the front of the locker and having a front sill extending downwardly and outwardly from the front surface of the bottom wall with the sill spaced below and extending under the door;

d. wherein when the door is closed, the inner surface of the door on the opposite side proximate the latch contacts the front surface of the second side wall, and there is space between the inner surface of a lower portion of the door and the front surface of the bottom wall and space between the top of the sill and the bottom of door to allow liquid within the locker to drain out of the locker under the door when the door is closed.

5. The receptacle of claim 4 wherein the latch on the door has a finger with a front cam surface and a flat back surface that cooperates with a catch having a recess and a recess wall in the second side wall to keep the door closed, and there is a gap between the latch finger back surface and the catch recess wall when the door is in the closed condition.

6. The receptacle of claim 4 wherein the latch on the door has a finger with a front cam surface and a flat back surface that cooperates with a latch having a recess and a recess wall in the second side wall to keep the door closed, and the finger back surface contacts the catch recess wall, and there is a gap between the inner surface of the opposite side of the door proximate the latch and the front surface of the second locker side wall when the door is in the closed condition.

7. The receptacle of claim 6 wherein the second side wall has a vertical frame at its front end and the recess wall is formed by the vertical frame.

8. The receptacle of claim 4 wherein the first side wall has a vertical frame at its front end and the door has a frame on one side and the hinge is incorporated into the door frame to cooperate with the vertical frame at the front end of the first side wall.

9. The receptacle of claim 4 also having a back wall and wherein the junction of the first, second and back walls with the bottom wall is water tight.

10. The receptacle of claim 4 also having a spacer between the bottom of the door proximate the hinge and the sill.

11. The receptacle of claim 4 also having a back wall wherein the back wall is a lockable door to allow ingress into the locker from inside the residence.

* * * * *